US008881519B2

(12) United States Patent
Kamimura

(10) Patent No.: US 8,881,519 B2
(45) Date of Patent: Nov. 11, 2014

(54) SLEWING TYPE WORKING MACHINE

(75) Inventor: Yusuke Kamimura, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 0 days.

(21) Appl. No.: 14/008,207

(22) PCT Filed: Apr. 19, 2012

(86) PCT No.: PCT/JP2012/002718

§ 371 (c)(1),
(2), (4) Date: Sep. 27, 2013

(87) PCT Pub. No.: WO2012/150650

PCT Pub. Date: Nov. 8, 2012

(65) Prior Publication Data

US 2014/0044514 A1 Feb. 13, 2014

(30) Foreign Application Priority Data

May 2, 2011 (JP) ..... 2011-103058

(51) Int. Cl.
*E02F 9/12* (2006.01)
*E02F 9/22* (2006.01)
*F15B 21/14* (2006.01)

(52) U.S. Cl.
CPC ..... *E02F 9/123* (2013.01); *F15B 2211/50527* (2013.01); *E02F 9/2228* (2013.01); *F15B 2211/6316* (2013.01); *F15B 2211/88* (2013.01); *E02F 9/2285* (2013.01); *F15B 21/14* (2013.01); *F15B 2211/3116* (2013.01); *F15B 2211/7058* (2013.01); *F15B 2211/6336* (2013.01); *F15B 2211/6313* (2013.01)
USPC ..... 60/468; 60/414; 60/493; 60/448

(58) Field of Classification Search
CPC .... F15B 11/024; F15B 22/042; F15B 22/044; F15B 21/087; F15B 2011/0243; F15B 21/14; F15B 2211/7058; F15B 2211/50527; F15B 2211/88; F15B 2211/6313; F15B 2211/6336; F15B 2211/6316; F15B 2211/3116; E02F 9/123; E02F 9/2285; E02F 9/2228
USPC ..... 60/445, 448, 459, 468, 493, 414, 403
See application file for complete search history.

(56) References Cited

U.S. PATENT DOCUMENTS 6,732,513 B2 * 5/2004 Tajima ..... 60/468
6,761,029 B2 * 7/2004 Linerode ..... 60/459

(Continued)

FOREIGN PATENT DOCUMENTS

JP 8 200305 8/1996
JP 2005 344431 12/2005

(Continued)

OTHER PUBLICATIONS

International Search Report Issued Jul. 31, 2012 in PCT/JP12/002718 Filed Apr. 19, 2012.

(Continued)

*Primary Examiner* — Ned Landrum
*Assistant Examiner* — Logan Kraft
(74) *Attorney, Agent, or Firm* — Oblon, Spivak, McClelland, Maier & Neustadt, L.L.P.

(57) ABSTRACT

A slewing-type working machine capable of reducing back pressure generated during slewing. The slewing-type working machine includes: a base carrier; an upper slewing body; a hydraulic motor including first and second ports and slewing the upper slewing body; a hydraulic pump, a slewing operation device including an operating member; a control valve controlling the hydraulic motor based on the operation signal of the slewing operation device; first and second pipe-lines connecting the first and second ports of the hydraulic motor to the control valve; a communication switching device capable of switching communication and cutting of between both pipe-lines and the tank; and a switching command section operating the communication switching devices, when the upper slewing body is slewed, to bring only a pipe-line, which corresponds to a discharge-side pipe-line of the hydraulic motor, of the pipe-lines into communication with the tank, while bypassing the control valve.

8 Claims, 7 Drawing Sheets

(56) References Cited

U.S. PATENT DOCUMENTS

| | | | | |
|---|---|---|---|---|
| 7,066,446 | B2 * | 6/2006 | Nielsen | 251/321 |
| 7,698,891 | B2 * | 4/2010 | Haramoto et al. | 60/448 |
| 8,635,939 | B2 * | 1/2014 | Linjama et al. | 91/6.5 |
| 2010/0263364 | A1 * | 10/2010 | Tsutsui et al. | 60/466 |
| 2013/0213026 | A1 | 8/2013 | Yamamoto et al. | |

FOREIGN PATENT DOCUMENTS

| | | | |
|---|---|---|---|
| JP | 2008063888 | A * | 3/2008 |
| JP | 2010 65510 | | 3/2010 |
| JP | 2012 127123 | | 7/2012 |
| WO | 2012/035735 | | 3/2012 |

OTHER PUBLICATIONS

Japanese Office Action Issued Jul. 24, 2012 in JP Patent Application No. 2011-103058 Filed May 2, 2011(with English translation.

* cited by examiner

SLEWING TYPE WORKING MACHINE

TECHNICAL FIELD

The present invention relates to a slewing-type working machine such as an excavator.

BACKGROUND ART

The background art of the present invention will be described using an excavator as an example.

For example, as shown in FIG. 7, a general excavator comprises a crawler-type base carrier 1, an upper slewing body 2 mounted on the base carrier 1 so as to be capable of being slewed around an axis X perpendicular to the ground, and an excavating attachment 3 attached to the upper slewing body 2. The excavating attachment 3 includes: a boom 4 capable of being raised and lowered; an arm 5 attached to a tip of the boom 4; a bucket 6 attached to a tip of the arm 5; and respective cylinders (hydraulic cylinders) for actuating the boom 4, the arm 5, and the bucket 6, namely, a boom cylinder 7, an arm cylinder 8, and a bucket cylinder 9.

FIG. 8 shows an example of a conventional hydraulic circuit for slewing the upper slewing body 2. The circuit includes: a hydraulic pump 10 as a hydraulic pressure source that is driven by an engine not graphically shown; a slewing hydraulic motor 11 which is rotated by hydraulic pressure supplied from the hydraulic pump 10 to drive the upper slewing body 2 to slew it; a remote-control valve 12 as a slewing operation device including a lever 12*a* that is operated to input a command for the slewing; and a control valve 13 which is a pilot-operated selector valve that can be operated by the remote-control valve 12 and provided between the hydraulic motor 11*a* and a pair of the hydraulic pump 10 and a tank T.

The lever 12*a* of the remote-control valve 12 is operated between a neutral position and right and left slewing positions, and the remote-control valve 12 outputs a pilot pressure with a magnitude corresponding to an operation amount of the lever 12*a* from a port corresponding to an operation direction of the lever 12*a*. The control valve 13 is switched from a graphically shown neutral position 13*a* to a left slewing position 13*b* or a right slewing position 13*c* by the pilot pressure, thereby controlling respective directions of supply of the hydraulic fluid to the hydraulic motor 11 and of right and left discharge of the hydraulic fluid from the hydraulic motor 11, and a flow rate of the hydraulic fluid. In other words, performed are: switching slewing state, that is, selectively switching to respective states of acceleration (including start-up), steady operation at a constant speed, deceleration, and stop; and controlling slewing direction and slew speed.

The control valve 13 and respective right and left ports of the hydraulic motor 11 are interconnected through a right slewing pipe-line 15 and a left slewing pipe-line 14. Between both slewing pipe-lines 14 and 15, provided are a relief valve circuit 18, a check valve circuit 21, and a communication path 22. The relief valve circuit 18 is provided so as to interconnect the slewing pipe-lines 14 and 15, and the relief valve circuit 18 is provided with a pair of relief valves 16 and 17 having respective outlets which are opposed and connected to each other. The check valve circuit 21 is provided so as to interconnect the slewing pipe-lines 14 and 15 at a position closer to the hydraulic motor 11 than the relief valve circuit 18, and the check valve circuit 21 is provided with a pair of check valves 19 and 20 having respective inlets which are opposed and connected to each other. The communication path 22 connects a first portion of the relief valve circuit 18, the first portion located between both relief valves 16 and 17, to a second portion of the check valve circuit 21, the second portion located between both check valves 19. The communication path 22 is connected to the tank T through a make-up line 23 for sucking up hydraulic fluid, and the make-up line 23 is provided with a back pressure valve 24.

In this circuit, when the remote-control valve 12 is not operated, that is, when the lever 12*a* thereof is at a neutral position, the control valve 13 is kept at the neutral position 13*a*; when the lever 12*a* of the remote-control valve 12 is operated to the left or the right from the neutral position, the control valve 13 moves from the neutral position 13*a* to the left slewing position 13*b* or the right slewing position 13*c* in accordance with an operating direction of the lever 12*a*, by a stroke in accordance with an operation amount of the lever 12*a*.

At the neutral position 13*a*, the control valve 13 blocks both slewing pipe-lines 14 and 15 from the pump 10 to prevent the hydraulic motor 11 from rotation; when switched to the left slewing position 13*b* or the right slewing position 13*c*, the control valve 13 allows hydraulic fluid from the pump 10 to be supplied to the left slewing pipe-line 14 or the right slewing pipe-line 15 to thereby bring the hydraulic motor 11 into a slewing-driving state of left or right rotating to slew the upper slewing body 2. The slewing-driving state includes both an accelerative slewing state including start-up and a steady operation state at a constant rotational speed. Meanwhile, the fluid discharged from the hydraulic motor 11 is returned to the tank T via the control valve 13.

Next will be described deceleration of slewing. For example, in the rightward slewing, upon a deceleration operation applied to the remote-control valve 12, specifically, upon an operation for returning the lever 12*a* to the neutral position or to the side of the neutral position, the control valve 13 is operated to the side of returning to the neutral position 13*a* to stop the supply of hydraulic fluid to the hydraulic motor 11 and the return of hydraulic fluid from the hydraulic motor 11 to the tank T, or to reduce a supply flow rate and a return flow rate of the hydraulic fluid. Meanwhile, the hydraulic motor 11 continue its clockwise rotation due to the inertia of the upper slewing body 2, thus raising pressure in the left slewing pipe-line 14 as a meter-out-side line. When the raised pressure reaches a certain value, the relief valve 16 on the left side in the diagram is opened to allow hydraulic fluid in the left slewing pipe-line 14 to flow into the hydraulic motor 11 through the relief valve 16, the communication path 22, the check valve 20 on the right side in the diagram, and the right slewing pipe-line 15 as indicated by a dashed-line arrow in FIG. 6. This gives a braking force due to the action of the relief valve 16 against the hydraulic motor 11 which continues to rotate due to the inertia, thereby decelerating and stopping the hydraulic motor 11. Decelerating and stopping the leftward slewing are similarly performed. On the other hand, when the slewing pipe-line 14 or 15 is subjected to negative pressure during the deceleration, the hydraulic fluid in the tank T is sucked up into the slewing pipe-line 14 or 15 through the make-up line 23, the communication path 22 and the check valve circuit 21, thereby preventing cavitation.

The above-mentioned slewing and deceleration are disclosed in, for example, Japanese Patent Application Laid-open No. 2010-65510 (Patent Document 1). In addition, Patent Document 1 also discloses a technique involving connecting an electric motor to the hydraulic motor 11 to make the electric motor assist the hydraulic motor 11 in slewing, while making the electric motor perform power regeneration during the deceleration to assist braking action and charge the generated regenerative power to a battery.

This technique, however, involves a problem of generating back pressure during slewing to increase power loss. Specifically, in the slewing, the control valve 13 throttles a return flow path from the hydraulic motor 11 to the tank T to thereby generate back pressure in a meter-out-side pipe-line, that is, a pipe-line on a discharge side of the hydraulic motor 11, namely, the left slewing pipe-line 14 during rightward slewing or the right slewing pipe-line 15 during leftward slewing. The back pressure increases a motor flow-in-side, i.e., a meter-in-side, pressure, in other words, that is, a discharge pressure of the hydraulic pump 10, to thus increase load on the hydraulic pump 10, resulting in significant power loss.

Patent Document 1: Japanese Patent Application Laid-open No. 2010-65510

SUMMARY OF THE INVENTION

An object of the present invention is to provide a slewing-type working machine capable of reducing back pressure generated when slewing is performed to thus suppress power loss due to the back pressure. The slewing-type working machine provided by the present invention includes: a base carrier; an upper slewing body mounted on the base carrier so as to be capable of slewing; a hydraulic motor including first and second ports and adapted to receive supply of hydraulic fluid from one of the ports and discharge the hydraulic fluid from the other one of the ports, thereby operating to slew the upper slewing body; a hydraulic pump discharging the hydraulic fluid which is to be supplied to the hydraulic motor; a slewing operation device including an operating member to which an operation is applied to input a command for the slewing and outputting an operation signal corresponding to an operation applied to the operating member; a control valve which is operated so as to control supply of hydraulic fluid to the hydraulic motor and discharge of hydraulic fluid from the hydraulic motor, based on the operation signal of the slewing operation device; a first pipe-line connecting the first port of the hydraulic motor to the control valve; a second pipe-line connecting the second port of the hydraulic motor to the control valve; a communication switching device provided between both of first and second pipe-lines and a tank to be switched among a state of cutting off both of the first and second pipe-lines from the tank, a state of bringing the first pipe-line into communication with the tank while cutting off the second pipe-line from the tank, and a state of bringing the second pipe-line into communication with the tank while cutting off the first pipe-line from the tank; and a switching command section which inputs a command signal to the communication switching device to switch the states thereof, the switching command section adapted to cause the communication switching device to bring, when the upper slewing body is slewed by the hydraulic motor, only a pipe-line that is one of the first and second pipe-lines and corresponds to a pipe-line on the discharge side of the hydraulic motor into communication with the tank, while bypassing the control valve.

EMBODIMENT FOR CARRYING OUT THE INVENTION

Figure 7:
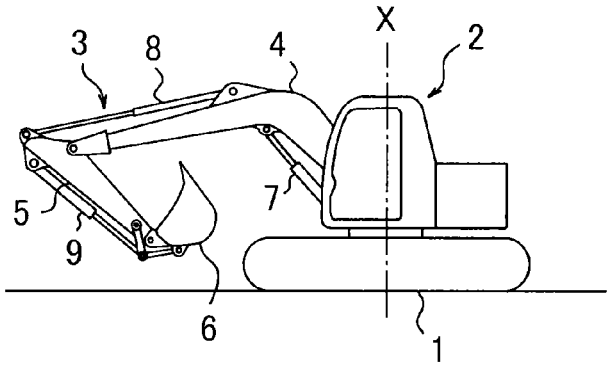
FIG. 7 is a side view showing a general excavator.
Figure 8:
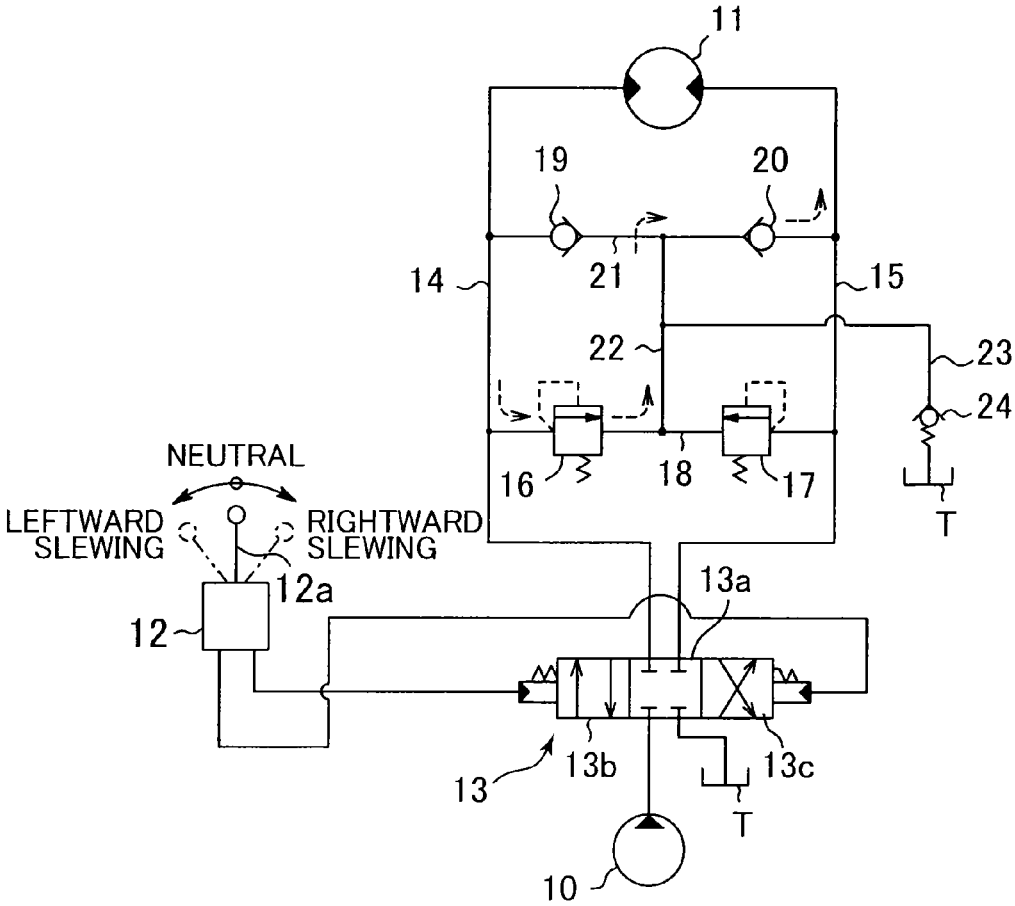
FIG. 8 is a diagram showing an example of a hydraulic circuit installed on a conventional working machine.

There will be described embodiments of the present invention. The embodiments are applied to the excavator shown in FIG. 7, similarly to the above-described background art.

Figure 1:
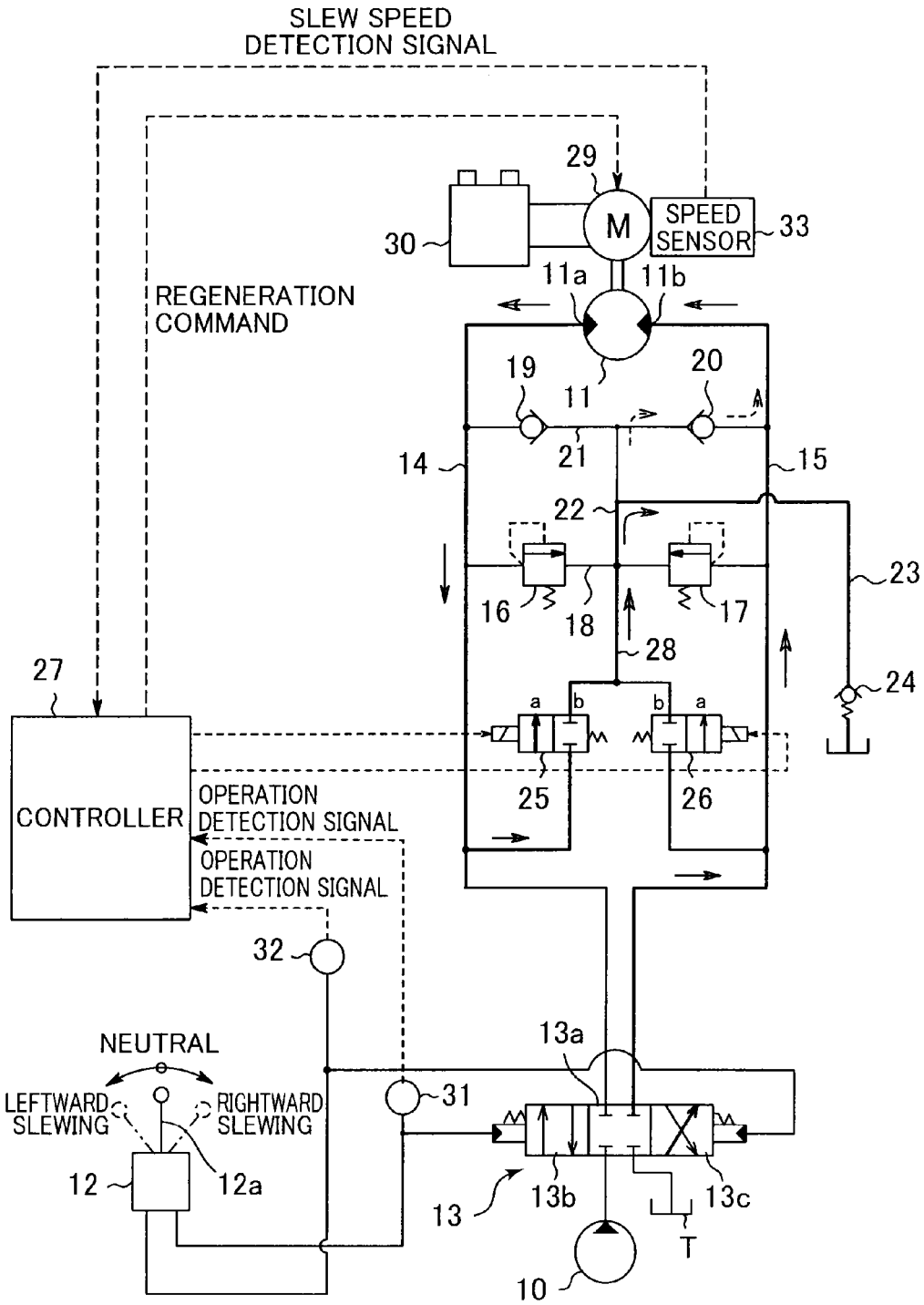
FIG. 1 is a diagram showing a hydraulic circuit according to a first embodiment of the present invention.

FIG. 1 shows a hydraulic circuit according to the first embodiment of the present invention. The circuit includes: a hydraulic pump 10 as a hydraulic pressure source, which is driven by an engine not graphically shown; a slewing hydraulic motor 11 which is rotated by supply of hydraulic fluid discharged from the hydraulic pump 10 to drive the upper slewing body 2 to slew it, a remote-control valve 12 as a slewing operation device including a lever 12*a* to which an operation is applied to input a slewing command; and a control valve 13 which is a pilot controlled selector valve that can be operated by the remote-control valve 12 and is provided between the hydraulic motor 11 and a pair of the hydraulic pump 10 and a tank T.

The hydraulic motor 11 includes a left port 11*a* and a right port 11*b* which are first and second ports, respectively. When supplied with hydraulic fluid through the left port 11*a*, the hydraulic motor 11 discharges the hydraulic fluid through the right port 11*b* while leftward slewing the upper slewing body 2 shown in FIG. 7. Conversely, when supplied with hydraulic fluid through the right port 11*b*, the hydraulic motor 11 discharges the hydraulic fluid through the left port 11*a* while rightward slewing the upper slewing body 2.

The lever 12*a* of the remote-control valve 12 is operated between a neutral position and right and left slewing positions, and the remote-control valve 12 outputs pilot pressure with a magnitude corresponding to an operation amount of the lever 12*a* from a port corresponding to an operation direction of the lever 12*a*. The control valve 13 is switched from a graphically shown neutral position 13*a* to a left slewing position 13*b* or a right slewing position 13*c* by the pilot pressure, thereby controlling respective directions of supply of the hydraulic fluid to the hydraulic motor 11 and of right and left discharge of the hydraulic fluid from the hydraulic motor 11, and a flow rate of the hydraulic fluid. In other words, performed are: switching slewing state, that is, selectively switching to respective states of acceleration (including start-up), steady operation at a constant speed, deceleration, and stop; and controlling slewing direction and slew speed.

The circuit includes a left slewing pipe-line 14 and a right slewing pipe-line 15 which are the first and second pipe-lines, respectively, a relief valve circuit 18, a check valve circuit 21, a communication path 22, and a make-up line 23.

The left slewing pipe-line 14 connects the control valve 13 to the left port 11*a* of the hydraulic motor 11, and the right slewing pipe-line 15 connects the control valve 13 to the right port 11*b* of the hydraulic motor 11. The relief valve circuit 18, the check valve circuit 21, and the communication path 22 are provided between both slewing pipe-lines 14 and 15.

The relief valve circuit 18 is provided so as to interconnect the slewing pipe-lines 14 and 15. The relief valve circuit 18 includes a pair of relief valves 16 and 17 having respective outlets which are opposed and connected to each other.

The check valve circuit 21 is arranged parallel to the relief valve circuit 18 at a position closer to the hydraulic motor 11 than the relief valve circuit 18 so as to interconnect the slewing pipe-lines 14 and 15. The check valve circuit 21 includes a pair of check valves 19 and 20 having respective inlets which are opposed and connected to each other.

The communication path 22 connects a first portion of the relief valve circuit 18, the portion located between the relief valves 16 and 17 to a second portion of the check valve circuit 21, the second portion located between the check valves 19 and 20. The make-up line 23 connects the communication path 22 to the tank T in order to suck up hydraulic fluid. The make-up line 23 is provided with a back pressure valve 24.

In addition, the circuit according to the first embodiment comprises: a left communication valve 25 and a right communication valve 26 which are respective first communication valve and the second communication valve constituting a communication switching device; a controller 27; a slewing electric motor 29 capable of being rotationally driven by the hydraulic motor 11, a electric storage device 30; pressure sensors 31 and 32 which are operation detectors, and a speed sensor 33 which is a speed detector.

Each of the communication valves 25 and 26 comprises a solenoid selector valve and is switched between an open position "a" and a closed position "b" by command signals inputted from the controller 27. The communication valves 25 and 26 include respective inlet-side ports connected to the slewing pipe-lines 14 and 15, respectively, and respective outlet-side ports connected via a passage 28 to a portion of the relief valve circuit 18, the portion located between both relief valves 16 and 17. The portion of the relief valve circuit 18, connected to the tank T through the communication path 22 and the make-up line 23 as described earlier, brings the respective slewing pipe-lines 14 and 15 into direct communication with the tank T, while bypassing the control valve 13, when each of the communication valves 25 and 26 is set to the open position "a".

The pressure sensors 31 and 32 detect respective operations applied to the remote-control valve 12 through respective pilot pressures outputted from the remote-control valve 12, in other words, detect whether the lever 12*a* is located at the neutral position or applied with an operation for rightward or leftward slewing. Specifically, the pressure sensors 31 and 32 output respective operation detection signals corresponding to respective pilot pressures outputted from the remote-control valve 12. The speed sensor 33 detects a rotational speed of the slewing electric motor 29, that is, a speed corresponding to a slew speed of the upper slewing body 2, and outputs a slew speed detection signal.

The controller 27, based on the operation detection signal inputted from the pressure sensors 31 and 32 and on the slew speed detection signal inputted from the speed sensor 33, judges whether the upper slewing body 2 is being driven for slewing (accelerating including start-up or in steady operation), or decelerated, or in a stopped state. Upon judgment that the upper slewing body 2 is being driven for slewing, the controller 27 switches only one of the communication valves 25 and 26*a*, the communication valve opposite to the operated communication valve, in other words, the communication valve connected to the discharge-side pipe-line which is one of the slewing pipe-lines 14 and 15 and into which hydraulic fluid from the hydraulic motor 11 is discharged to the open position "a" (hereinafter, the communication valve connected to the discharge-side pipe-line will be indicated as a "discharge-side communication valve", which corresponds to, during a rightward slewing, the left communication valve 25 connected to the left slewing pipe-line 14, while corresponds to, during a leftward slewing, the right communication valve 26 that connects to the right slewing pipe-line 15).

Accordingly, hydraulic fluid discharged during slewing from the hydraulic motor 11 to the left slewing pipe-line 14 or the right slewing pipe-line 15 passes through the communication valve 25 or 26 that is connected to the discharge-side pipe path and is directly returned to the tank T, while bypassing the control valve 13. For example, during the rightward slewing, hydraulic fluid discharged from the hydraulic motor 11 sequentially passes through the left slewing pipe-line 14, the left communication valve 25, the passage 28, the communication path 22, and the make-up line 23 before returning to the tank T, as indicated by bold line and solid line arrows in FIG. 1. During the slewing, the slewing electric motor 29 is rotated so as to be involved by the hydraulic motor 11. In other words, the slewing electric motor 29 is driven by the hydraulic motor 11.

For example, when the lever 12*a* of the remote-control valve 12 is subject to an operation in the rightward slewing state, in a direction for deceleration, i.e., operated so as to be returned to the neutral position or so as to approach the neutral position, the hydraulic fluid is circulated, as indicated by the dashed-line arrow in FIG. 1, so as to return to the right slewing pipe-line 15 from the communication path 22 through the right check valve 20 of the check valve circuit 21. Meanwhile, the slewing electric motor 29 performs a generator (regenerative) action in accordance with the regeneration command from the controller 27, exerting a braking force against the rotation of the hydraulic motor 11 and transmitting the generated regenerative power to the electric storage device 30 to charge it. This regenerative action causes a brake against the rotation of the hydraulic motor 11, resulting in deceleration/stop of the upper slewing body 2.

Figure 2:
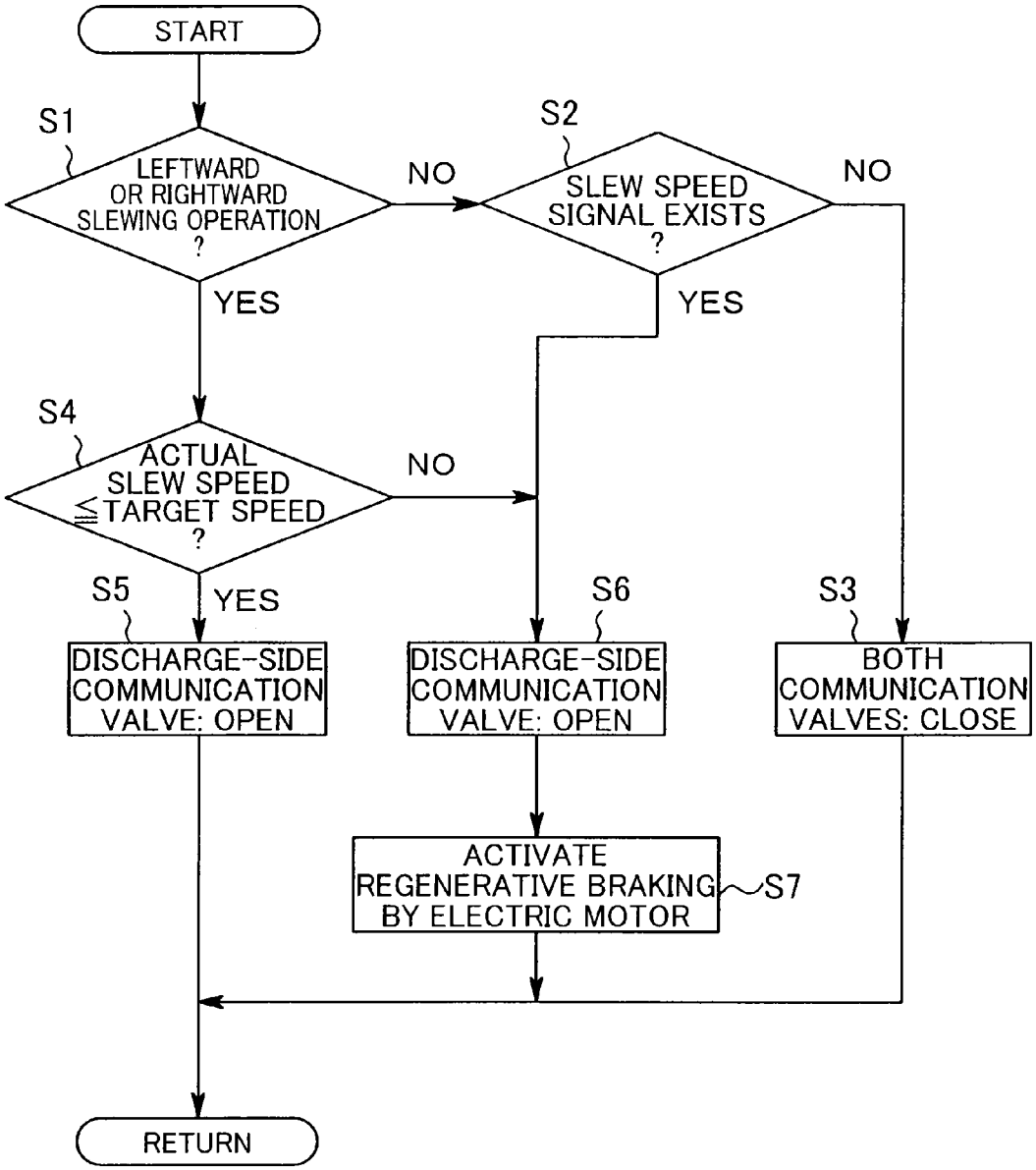
FIG. 2 is a flow chart showing a control operation of a controller according to the first embodiment.

FIG. 2 shows a specific control operation which the controller 27 performs.

In step S1, the controller 27 judges whether the operation for rightward or leftward slewing has been applied to the lever 12*a*. Upon judgment NO, i.e., no operation, the controller 27 judges in step S2 whether or not there exists a slew speed detection signal from the speed sensor 33. If NO in both steps Si and S2, that is, in the case of no slewing operation and no slew speed detection signal, the controller 27, assuming that slewing is being stopped, causes both of the communication valves 25 and 26 to be closed in step S3.

In contrast, if YES in step S1, i.e., judging that an operation has been performed, the controller 27, assuming that slewing is being performed, carries out step S4, that is, compares an actual slew speed with a target speed determined based on the operation amount in the remote-control valve 12 (the target speed is previously set and stored in the controller 27 in the form of, for example, a map). In the case of YES, i.e., in the case of the actual speed being equal to or lower than the target speed, the controller 27, assuming that acceleration or a steady operation is being performed, causes only the discharge-side communication valve of the communication valves 25 and 26 in step S5 and returning to step S1.

On the other hand, in the case of NO in step S4, i.e., in the case of the actual speed being higher than the target speed, the controller 27, assuming that the lever 12*a* of the remote-control valve 12 has been operated to return to the neutral position and the slewing is being decelerated, carries out step S6, that is, causes the discharge-side communication valve to be opened, similarly to the case of slewing acceleration and steady operation. Besides, in the case of YES in step S2, i.e., in the case where no slewing operation but any slew speed detection signal exists, the controller 27, assuming that the slewing is being decelerated while the remote-control valve 12 has been operated to return to neutral, also causes the opposite-side communication valve to be opened in step S6. After step S6, the controller 27 outputs a regeneration command toward the slewing electric motor 29 to cause it to perform a regenerative braking action in step S7, thereby causing a brake against the hydraulic motor 11.

The controller 27, thus causing the communication valve 25 or 26 to be opened, when slewing is being performed, to return the fluid discharged from the hydraulic motor 11 directly to the tank through the communication valve 25 or 26 while bypassing the control valve 13, can eliminate back pressure due to a throttle action by the control valve 13. This makes it possible to reduce the back pressure that acts on the meter-out-side of the hydraulic motor 11 and reduce the meter-in-side pressure or pump pressure, when slewing is being performed; thus power loss of the hydraulic pump 10 can be suppressed to minimize energy wasting. Besides, when the slewing is decelerated, causing the electric motor 29 to perform a regenerative action allows the slewing energy to be regenerated as a storage power, which enables energy efficiency to be improved.

The communication valves 25 and 26, while being permitted to be connected to the tank T through a dedicated external pile-line, also can be connected to the tank T by utilization of the existing communication path 22 and the make-up line 23 as shown in FIG. 1, thus allowing a circuit configuration to be simplified. Besides, the present first embodiment, while being originally designed suitably for a hybrid machine including an electric storage device as a power source, also can be readily applied to a hydraulic slewing-type working machine such as a hydraulic excavator with adding the slewing electric motor 29 and the electric storage device 30.

Figure 3:
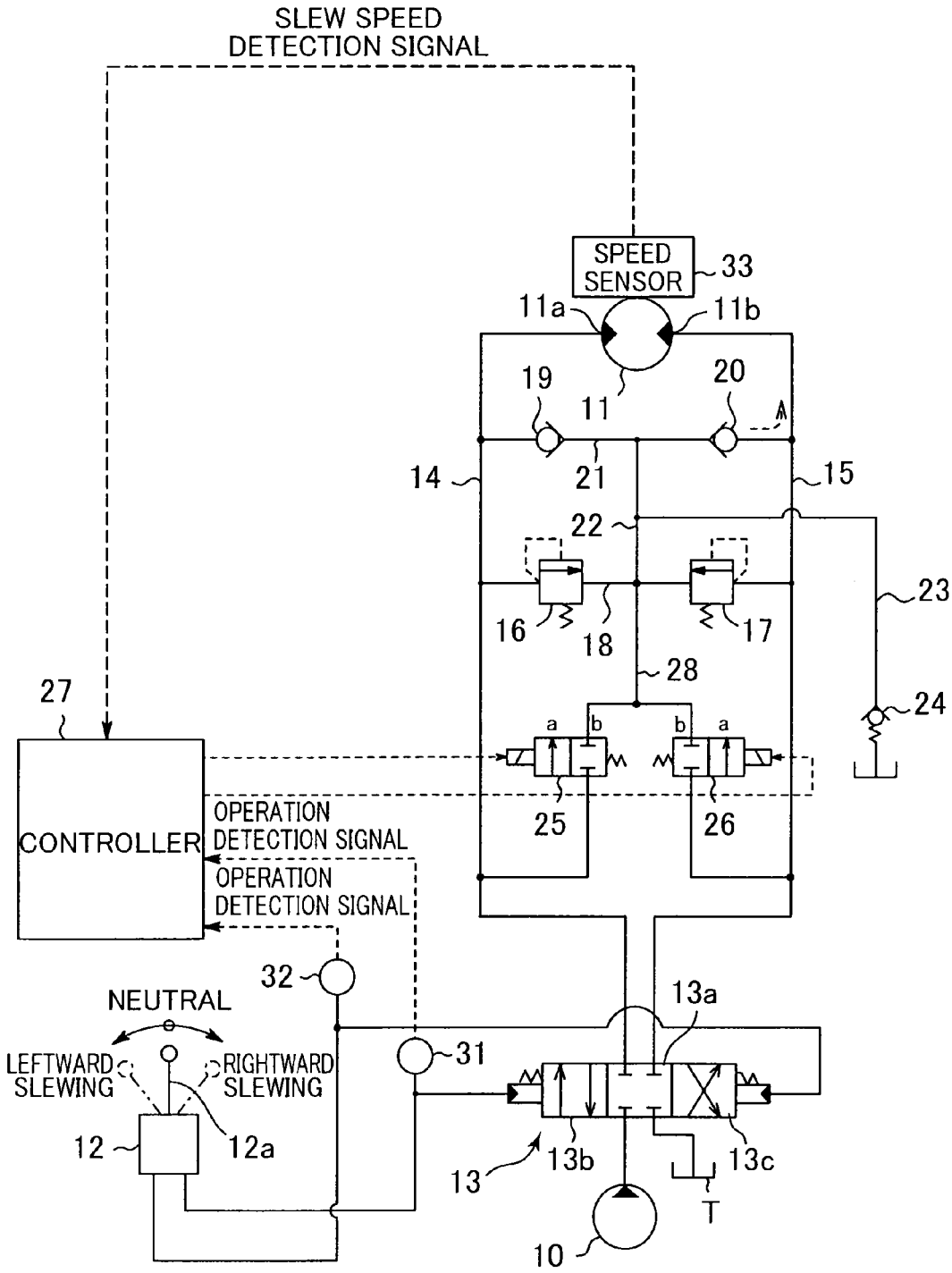
FIG. 3 is a diagram showing a hydraulic circuit according to a second embodiment of the present invention.

Next will be described a second embodiment of the present invention with reference to FIGS. 3 and 4. The second embodiment differs only in that: (1) the electric motor 29 and the electric storage device 30 have been omitted, (2) the speed sensor 33 detects rotational speed of the hydraulic motor 11, and (3) the discharge-side communication valve of the communication valves 25 and 26 is switched to the open position "a", only during slewing, to reduce back pressure, while the discharge-side communication valve is returned to the closed position "b" during slewing deceleration. Returning the discharge-side communication valve to the closed position "b" during slewing deceleration enables the relief valve circuit 18 to exert so-called neutral brake similarly to conventional cases by no use of the communication valves 25 and 26.

Figure 4:
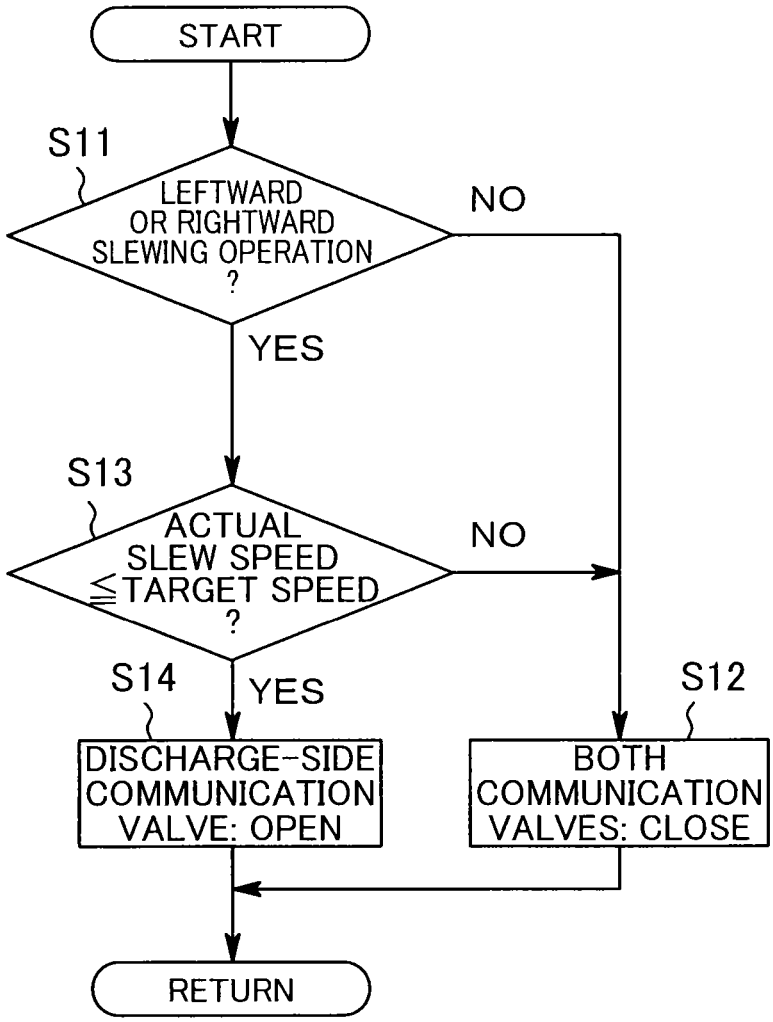
FIG. 4 is a flow chart showing a control operation of a controller according to the second embodiment.

FIG. 4 shows a specific control operation by the controller 27 according to the second embodiment.

The controller 27 judges in step S11 whether or not rightward or leftward slewing operation has been performed; if NO, i.e., if no operation, the controller 27, assuming that the slewing is being decelerated or stopped by a neutral return operation, causes both communication valves 25 and 26 to be closed in step S12. In contrast, in the case of YES in step S11, i.e., in the case where any operation has been performed, the controller 27, assuming that the slewing is being accelerated, steadily performed, or decelerated by a neutral return operation, compares an actual slew speed with a target speed in step S 13. In the case of YES in step S13, i.e., in the case of the actual slew speed being equal to or lower than the target speed, the controller 27, assuming that the slewing is being steadily performed or accelerated, causes the opposite-side communication valve to be opened in step S14 and repeats step S11. On the other hand, in the case of NO in step S13, i.e., in the case of the actual slew speed being higher than the target speed, the controller 27, assuming that the slewing is being decelerated similarly to the case of no operation, causes both communication valves 25 and 26 to be closed in step S12.

This control by the controller 27 enables a hydraulic excavator with no use of a slewing electric motor to decelerate rotation of the hydraulic motor 11 by hydraulic braking instead of regenerative braking by an electric motor, upon a deceleration operation, thereby allowing simplification of facilities and cost reduction to be achieved. Besides, the control allows add-on to be easily performed to an existing machine by only adding the communication valves 25 and 26 and related piping thereof.

Figure 5:
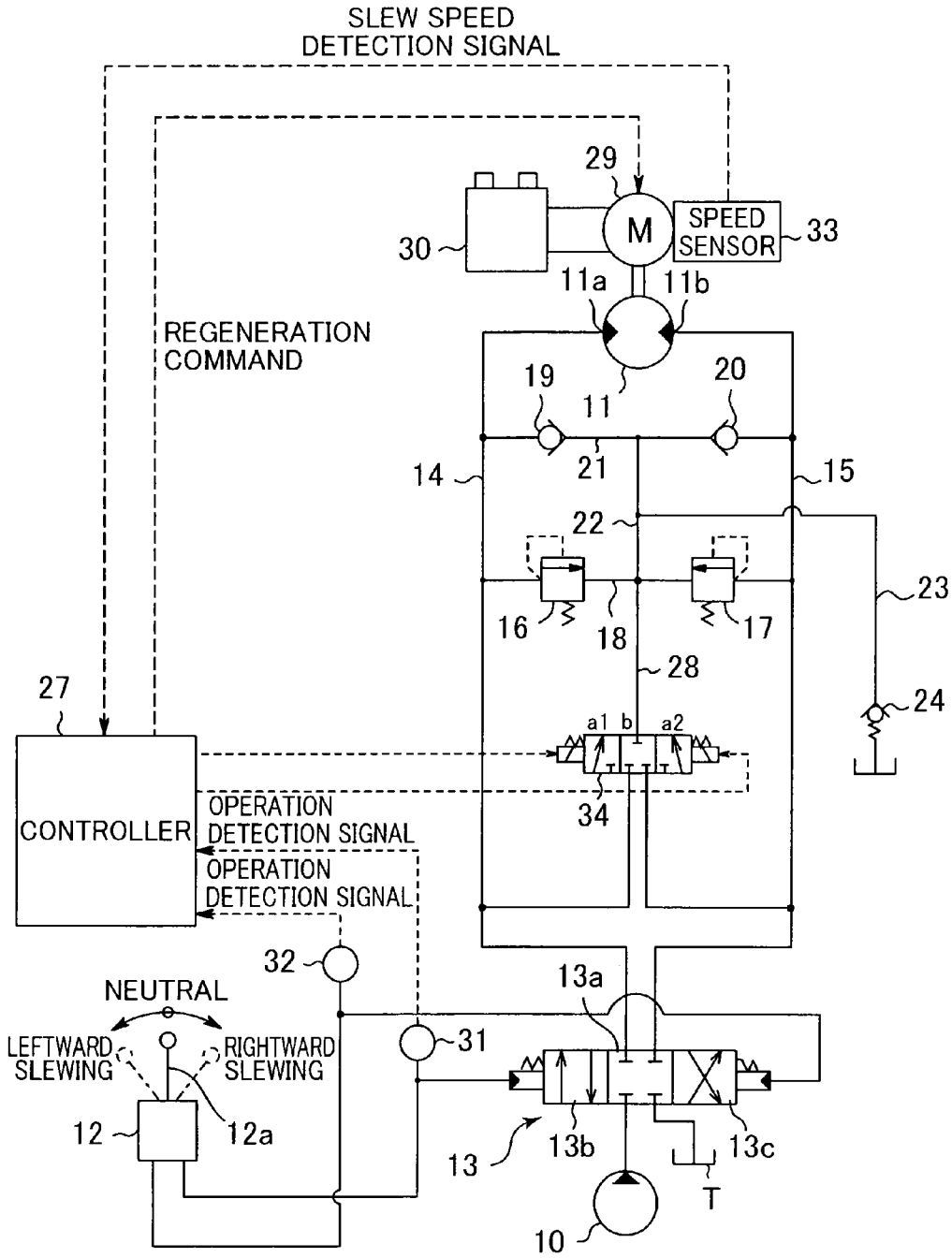
FIG. 5 is a diagram showing a hydraulic circuit according to a third embodiment of the present invention.

FIG. 5 shows a hydraulic circuit according to a third embodiment of the present invention. The present third embodiment only differs from the first embodiment in that the communication switching device is constituted by a common communication valve 34 which is shared by right and left slewing pipe-lines 14 and 15.

The common communication valve 34 comprises a solenoid selector valve, having a closed position "b" that is a neutral position, a left open position "a1" that is the first open position, and a right open position "a2" that is the second open position. These positions are switched by command signals that are inputted from the controller 27 similarly to the first embodiment. The common communication valve 34 is adapted to: cut off both right and left slewing pipe-lines 14 and 15 from the tank T at the closed position "b"; bring the left slewing pipe-line 14 into communication with the tank T while cutting off the right slewing pipe-line 15 from the tank T, at the left open position "a1"; and bring the right slewing pipe-line 15 into communication with the tank T while cutting off the left slewing pipe-line 14 from the tank T, at the right open position "a2". The controller 27 switches the common communication valve 34 from the closed position "b" to the left open position "a1" upon rightward slewing and switches the common communication valve 34 from the closed position "b" to the right open position "a2" upon leftward slewing.

Figure 6:
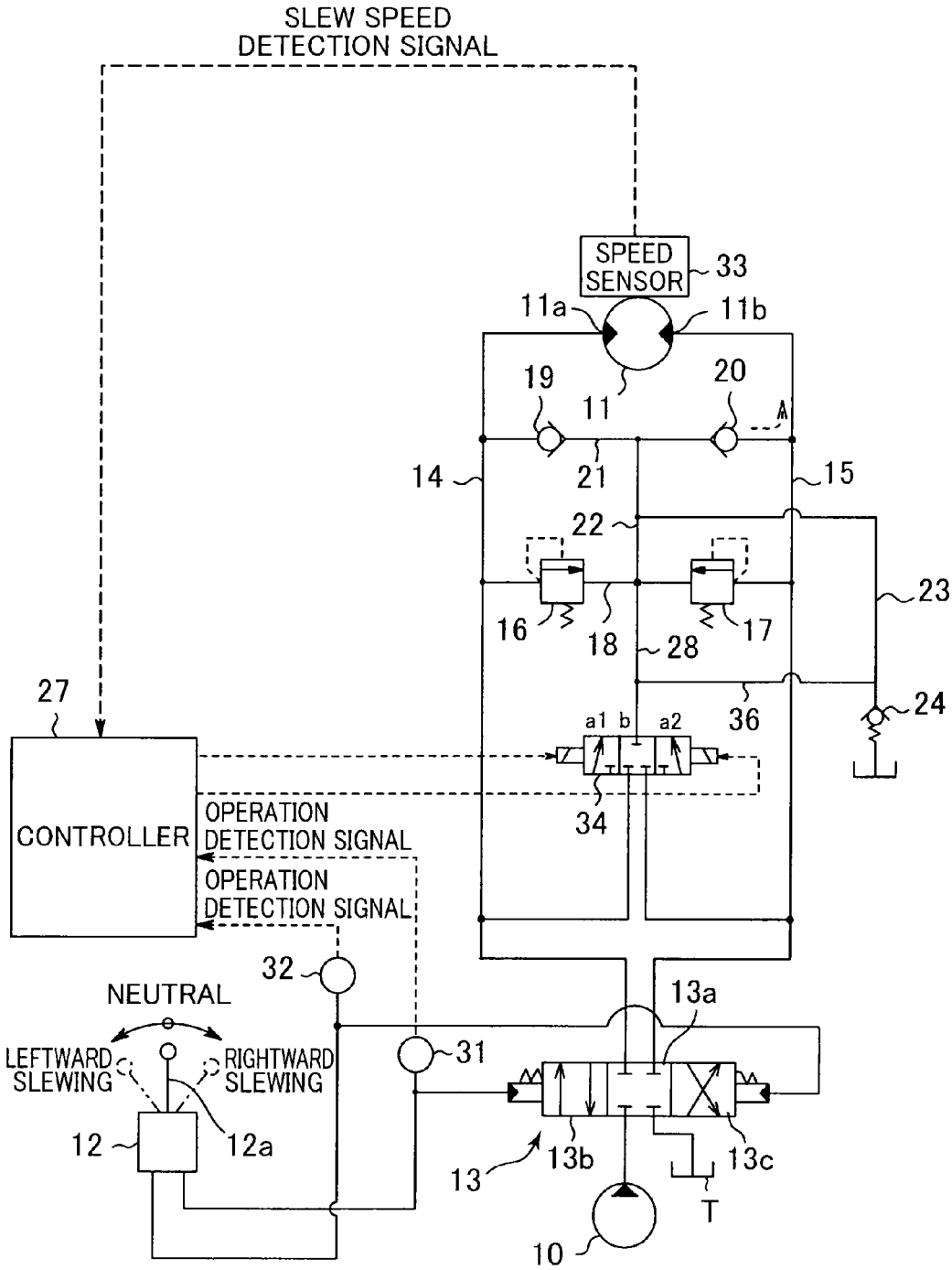
FIG. 6 is a diagram showing a hydraulic circuit according to a fourth embodiment of the present invention.

FIG. 6 shows a hydraulic circuit according to a fourth embodiment of the present invention. The present fourth embodiment differs from the second embodiment only in that both of the communication valves 25 and 26 according to the second embodiment have been replaced by a single common communication valve 34 to be shared by both slewing pipe-lines 14 and 15, similarly to the difference between the first embodiment and the third embodiment. While FIG. 6 shows a dedicated tank connection line 36 branching from the passage 28 to connect an outlet of the common communication valve 34 to the tank T, the outlet may be connected only to the communication path 22 similarly to the first to third embodiments.

According to the third and fourth embodiments, the single common communication valve 34, constituting the communication switching device, allows the communication switching device to be downsized and easily incorporated, compared to both of the first and second embodiments in which the communication valves 25 and 26 are independently provided to respective pipe-lines.

The switching command section according to the present invention is not limited to a controller that outputs an electric signal such as the controller 27. For example, the left and right communication valves 25 and 26 or the common communication valve 34 may comprise not a solenoid selector valve but a hydraulic pilot selector valve which has a pilot port and is operated by pilot pressure inputted to the pilot port, the pilot port connected to the remote-control valve 12 via a pilot pipe-line so as to cause the common communication valve 34 to be opened when slewing is performed. In this case, the pilot pipe-line corresponds to the "switching command section" according to the present invention. Braking for deceleration in this case may be performed by other means such as a mechanical brake.

The slewing-type working machine according to the present invention is not limited to an excavator. For example, the present invention may also be applied to other slewing-type working machines such as a demolition machine or a crusher configured with utilization of a mother body of an excavator.

As described above, according to the present invention, provided is a slewing-type working machine capable of reducing back pressure generated when slewing is performed to suppress power loss due to the back pressure. The slewing-type working machine comprises: a base carrier; an upper slewing body mounted on the base carrier so as to be capable of being slewed; a hydraulic motor including first and second ports and adapted to receive supply of hydraulic fluid from one of the ports and discharge the hydraulic fluid from the other one of the ports, thereby operating to slew the upper slewing body; a hydraulic pump discharging the hydraulic fluid which is to be supplied to the hydraulic motor; a slewing operation device including an operating member to which an operation is applied to input a command for the slewing and outputting an operation signal corresponding to the operation applied to the operating member; a control valve which is operated so as to control supply of hydraulic fluid to the hydraulic motor and discharge of hydraulic fluid from the hydraulic motor, based on the operation signal of the slewing operation device; a first pipe-line connecting the first port of the hydraulic motor to the control valve; a second pipe-line connecting the second port of the hydraulic motor to the control valve; a communication switching device provided between both of first and second pipe-lines and a tank to be switched among a state of cutting off both of the first and second pipe-lines from the tank, a state of bringing the first pipe-line into communication with the tank while cutting off the second pipe-line from the tank, and a state of bringing the second pipe-line into communication with the tank while cutting off the first pipe-line from the tank; and a switching command section which inputs a command signal to the communication switching device to switch the states thereof, the switching command section adapted to cause the communication switching device to bring, when the upper slewing body is slewed by the hydraulic motor, only a pipe-line that is one of the first and second pipe-lines and corresponds to a pipe-line on the discharge side of the hydraulic motor into communication with the tank, while bypassing the control valve.

Thus returning the discharge-side pipe-line of the hydraulic motor directly to the tank by the communication switching device while bypassing the control valve, when the upper slewing body is slewed by the hydraulic motor, allows the back pressure due to a throttle action of the control valve to be eliminated. This makes it possible to reduce the back pressure acting on the meter-out-side of the hydraulic motor when the slewing is performed and thereby reduce meter-in-side pressure to lower the pump pressure. Power loss of the hydraulic pump is thus permitted to be reduced, minimizing energy wasting.

The switching command section is suitably, for example, a controller which inputs a command signal to the communication switching device to control a communication switching operation of the communication switching device.

In the case of comprising the controller, it is more preferable to comprise: a slewing electric motor which is rotationally driven by the hydraulic motor; an electric storage device; an operation detector which detects an operation applied to the slewing operation device; and a speed detector which detects a slew speed of the upper slewing body, wherein the communication switching device includes a communicating valve connected to the discharge-side pipe-line, and the controller judges whether or not the slewing of the upper slewing body is decelerated, based on detection signals of the operation detector and the speed detector, and keep the communicating valve at the open position, when judging that the slewing is decelerated, to cause the slewing electric motor to perform a generator action to exert a braking force, while maintaining communication between the discharge-side pipe-line and the tank, to charge the electric storage device with a regenerative power by the generator action. The electric motor, thus regenerating slewing energy of the upper slewing body as storage power when slewing is decelerated, enables energy efficiency to be enhanced.

Alternatively, it is also preferable that the working machine comprises: a relief valve; an operation detector detecting an operation applied to the slewing operation device; and a speed detector detecting a slew speed of the upper slewing body, wherein the communication switching device includes a communicating valve connected to the discharge-side pipe-line, and the controller judges whether or not the slewing of the upper slewing body is decelerated, based on detection signals of the operation detector and the speed detector, and switches the communication valve to a closed position, when judging that the slewing of the upper slewing body is decelerated, to cause the relief valve to exert a braking force against the hydraulic motor. Such a hydraulic braking against the hydraulic motor by utilization of the relief valve during deceleration enables the braking to be applied to the hydraulic motor with no use of the slewing electric motor, thereby contributing to simplified facilities and reduced cost. Besides, the controller can also be readily added on to an existing machine.

In the present invention, the communication switching device may include: a first communication valve which is provided between the first pipe-line and the tank and switched between an open position for bringing the first pipe-line into communication with the tank and a closed position for cutting off the first pipe-line from the tank; and a second communication valve which is provided between the second pipe-line and the tank and switched between an open position for bringing the second pipe-line into communication with the tank and a closed position for cutting off the second pipe-line from the tank. Alternatively, the communication switching device may include a common communication valve which is provided between both of the first and second pipe-lines and the tank and has a closed position for cutting off both of the first and second pipe-lines from the tank, a first open position for bringing the first pipe-line into communication with the tank while cutting off the second pipe-line from the tank, and a second open position for bringing the second pipe-line into communication with the tank while cutting off the first pipe-line from the tank, to be shared by both of the first and second pipe-lines.

The present invention can also be applied to a machine comprising: a relief valve circuit which is provided between the first pipe-line and the second pipe-line so as to interconnect both of the first and second pipe-lines and includes a pair of relief valves having respective outlet sides which are opposed and connected to each other; a check valve circuit which is provided parallel to the relief valve circuit between the first pipe-line and the second pipe-line so as to interconnect both of the first and second pipe-lines and includes a pair of check valves having respective inlet sides which are opposed and connected to each other; a communication path which connects a portion of the relief valve circuit which portion is located between both of the relief valves to a portion of the check valve circuit which portion is located between both of the check valves to each other; and a make-up line which connects the communication path to the tank to suck up hydraulic fluid. In this case, connecting the communication switching device to the communication path allows the communication selector valve to be connected to the tank with a simple configuration by utilization of the communication path and the make-up line. This enables the circuit configuration to be simplified compared to a case where the communication switching device is connected to the tank by a dedicated external pipe-line.

The invention claimed is:

1. A slewing-type working machine comprising:

a base carrier;

an upper slewing body mounted on the base carrier so as to be capable of being slewed;

a hydraulic motor including first and second ports and receiving supply of hydraulic fluid from one of the first and second ports and discharges the hydraulic fluid from the other one of the first and second ports, thereby slewing the upper slewing body;

a hydraulic pump discharging the hydraulic fluid supplied to the hydraulic motor;

a slewing operation device including an operating member to which an operation is applied to input a command for the slewing and outputting an operation signal corresponding to the operation applied to the operating member;

a control valve which is operated so as to control supply of hydraulic fluid to the hydraulic motor and discharge of hydraulic fluid from the hydraulic motor, based on the operation signal of the slewing operation device;

a first pipe-line connecting the first port of the hydraulic motor to the control valve;

a second pipe-line connecting the second port of the hydraulic motor to the control valve;

a communication switching device provided between both of first and second pipe-lines and a tank to be switched among a state of cutting off both of the first and second pipe-lines from the tank, a state of bringing the first pipe-line into communication with the tank while cutting off the second pipe-line from the tank, and a state of bringing the second pipe-line into communication with the tank while cutting off the first pipe-line from the tank;

a switching command section inputting a command signal to the communication switching device to switching the states, the switching command section adapted to cause the communication switching device to bring, when the upper slewing body is slewed by the hydraulic motor, only a pipe-line that is one of the first and second pipe-lines and corresponds to a pipe-line on the discharge side of the hydraulic motor into communication with the tank, while bypassing the control valve;

a slewing electric motor which is rotationally driven by the hydraulic motor;

an electric storage device; an operation detector which detects an operation applied to the slewing operation device; and a speed detector which detects a slew speed of the upper slewing body, wherein the switching command section is a controller which inputs a command signal to the communication switching device to control communication switching operations of the communication switching device, and the communication switching device includes a communicating valve connected to the discharge-side pipe-line, and the controller judges whether or not the slewing of the upper slewing body is decelerated, based on detection signals of the operation detector and the speed detector, and keeps the communicating valve at the open position, when judging that the slewing is decelerated, to cause the slewing electric motor to perform a generator action to exert a braking force, while maintaining communication between the discharge-side pipe- line and the tank, to charge the electric storage device with a regenerative power by the generator action.

2. The slewing-type working machine according to claim 1, wherein the communication switching device includes: a first communication valve which is provided between the first pipe-line and the tank and switched between an open position for bringing the first pipe-line into communication with the tank and a closed position for cutting off the first pipe-line from the tank; and a second communication valve which is provided between the second pipe-line and the tank and switched between an open position for bringing the second pipe-line into communication with the tank and a closed position for cutting off the second pipe-line from the tank.

3. The slewing-type working machine according to claim 1, wherein the communication switching device comprises a common communication valve which is provided between both pipe-lines and the tank and has a closed position for cutting off both of the first and second pipe-lines from the tank, a first open position for bringing the first pipe-line into communication with the tank while cutting off the second pipe-line from the tank, and a second open position for bringing the second pipe-line into communication with the tank while cutting off the first pipe-line from the tank, to be shared by both of the first and second pipe-lines.

4. The slewing-type working machine according to claim 1, further comprising: a relief valve circuit which is provided between the first pipe-line and the second pipe-line so as to interconnect both of the first and second pipe-lines and includes a pair of relief valves having respective outlet sides which are opposed and connected to each other; a check valve circuit which is provided parallel to the relief valve circuit between the first pipe-line and the second pipe-line so as to interconnect both of the first and second pipe-lines and includes a pair of check valves having respective inlet sides which are opposed and connected to each other; a communication path which connects a portion of the relief valve circuit which portion is located between both of the relief valves to a portion of the check valve circuit which portion is located between both of the check valves; and a make-up line which connects the communication path to the tank to suck up hydraulic fluid.

5. A slewing-type working machine comprising:

a base carrier;

an upper slewing body mounted on the base carrier so as to be capable of being slewed;

a hydraulic motor including first and second ports and receiving supply of hydraulic fluid from one of the first and second ports and discharges the hydraulic fluid from the other one of the first and second ports, thereby slewing the upper slewing body;

a hydraulic pump discharging the hydraulic fluid supplied to the hydraulic motor;

a slewing operation device including an operating member to which an operation is applied to input a command for the slewing and outputting an operation signal corresponding to the operation applied to the operating member;

a control valve which is operated so as to control supply of hydraulic fluid to the hydraulic motor and discharge of hydraulic fluid from the hydraulic motor, based on the operation signal of the slewing operation device;

a first pipe-line connecting the first port of the hydraulic motor to the control valve;

a second pipe-line connecting the second port of the hydraulic motor to the control valve;

a communication switching device provided between both of first and second pipe-lines and a tank to be switched among a state of cutting off both of the first and second pipe-lines from the tank, a state of bringing the first pipe-line into communication with the tank while cutting off the second pipe-line from the tank, and a state of bringing the second pipe-line into communication with the tank while cutting off the first pipe-line from the tank;

a switching command section inputting a command signal to the communication switching device to switching the states, the switching command section adapted to cause the communication switching device to bring, when the upper slewing body is slewed by the hydraulic motor, only a pipe-line that is one of the first and second pipe-lines and corresponds to a pipe-line on the discharge side of the hydraulic motor into communication with the tank, while bypassing the control valve;

a relief valve;

an operation detector which detects the operation applied to the slewing operation device; and a speed detector which detects a slew speed of the upper slewing body, wherein the switching command section is a controller which inputs a command signal to the communication switching device to control communication switching operations of the communication switching device, and the communication switching device includes a communicating valve connected to the discharge-side pipe-line, and the controller judges whether or not the slewing of the upper slewing body is decelerated, based on detection signals of the operation detector and the speed detector, and switches the communication valve to a closed position, when judging that the slewing of the upper slewing body is decelerated, to cause the relief valve to exert a braking force against the hydraulic motor.

6. The slewing-type working machine according to claim 5, wherein the communication switching device includes: a first communication valve which is provided between the first pipe-line and the tank and switched between an open position for bringing the first pipe-line into communication with the tank and a closed position for cutting off the first pipe-line from the tank; and a second communication valve which is provided between the second pipe-line and the tank and switched between an open position for bringing the second pipe-line into communication with the tank and a closed position for cutting off the second pipe-line from the tank.

7. The slewing-type working machine according to claim 5, wherein the communication switching device comprises a common communication valve which is provided between both pipe-lines and the tank and has a closed position for cutting off both of the first and second pipe-lines from the tank, a first open position for bringing the first pipe-line into communication with the tank while cutting off the second pipe-line from the tank, and a second open position for bringing the second pipe-line into communication with the tank while cutting off the first pipe-line from the tank, to be shared by both of the first and second pipe-lines.

8. The slewing-type working machine according to claim 5, further comprising: a relief valve circuit which is provided between the first pipe-line and the second pipe-line so as to interconnect both of the first and second pipe-lines and includes a pair of relief valves having respective outlet sides which are opposed and connected to each other; a check valve circuit which is provided parallel to the relief valve circuit between the first pipe-line and the second pipe-line so as to interconnect both of the first and second pipe-lines and includes a pair of check valves having respective inlet sides which are opposed and connected to each other; a communication path which connects a portion of the relief valve circuit which portion is located between both of the relief valves to a portion of the check valve circuit which portion is located between both of the check valves; and a make-up line which connects the communication path to the tank to suck up hydraulic fluid.

* * * * *